US010879656B2

(12) United States Patent
Wang et al.

(10) Patent No.: US 10,879,656 B2
(45) Date of Patent: Dec. 29, 2020

(54) PLUG CONNECTOR

(71) Applicant: Acer Incorporated, New Taipei (TW)

(72) Inventors: Yu-Shih Wang, New Taipei (TW); Chih-Chun Liu, New Taipei (TW); Wen-Chieh Tai, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 16/529,811

(22) Filed: Aug. 2, 2019

(65) Prior Publication Data

US 2020/0274305 A1 Aug. 27, 2020

(30) Foreign Application Priority Data

Feb. 23, 2019 (TW) ..... 108106175 A

(51) Int. Cl.

| | |
|---|---|
| ***H01R 24/62*** | (2011.01) |
| ***H01R 13/502*** | (2006.01) |
| ***H01R 13/66*** | (2006.01) |
| ***H01R 13/516*** | (2006.01) |
| ***H01R 13/42*** | (2006.01) |
| ***H01R 13/405*** | (2006.01) |

(52) U.S. Cl.

CPC ..... *H01R 24/62* (2013.01); *H01R 13/405* (2013.01); *H01R 13/42* (2013.01); *H01R 13/502* (2013.01); *H01R 13/516* (2013.01); *H01R 13/66* (2013.01)

(58) Field of Classification Search

CPC .. H01R 13/187; H01R 13/111; H01R 13/502; H01R 13/66; H01R 13/516; H01R 13/42; H01R 13/405; H01R 24/62

USPC ..... 439/843

See application file for complete search history.

(56) References Cited

U.S. PATENT DOCUMENTS

| | | | | |
|---|---|---|---|---|
| 3,763,460 A * | 10/1973 | Hatschek | ..... | H01R 13/533 439/277 |
| 4,753,616 A * | 6/1988 | Molitor | ..... | H01R 13/187 439/787 |
| 5,667,413 A * | 9/1997 | Trafton | ..... | H01R 13/187 439/271 |
| 6,062,919 A * | 5/2000 | Trafton | ..... | H01R 13/187 439/843 |

(Continued)

FOREIGN PATENT DOCUMENTS

| | | |
|---|---|---|
| CN | 204991977 | 1/2016 |
| CN | 206524475 | 9/2017 |

(Continued)

OTHER PUBLICATIONS

"Search Report of Europe Counterpart Application", dated Apr. 15, 2020, p. 1-p. 14.

*Primary Examiner* — Gary F Paumen
(74) *Attorney, Agent, or Firm* — JCIPRNET

(57) ABSTRACT

A plug connector includes a conductive body, an insulative body, and a ring shape conductive terminal. The conductive body has an assembling hole. The insulative body is sleeved on the conductive body, wherein the insulative body has an opening hole and the assembling hole is aligned with the opening hole. The ring shape conductive terminal is assembled in the assembling hole, wherein the ring shape conductive terminal includes a conductive inner ring and the conductive inner ring includes a plurality of conductive portions. The conductive portions are arranged circularly and each conductive portion has at least two conductive contacts.

9 Claims, 5 Drawing Sheets

(56) References Cited

U.S. PATENT DOCUMENTS

| | | | | |
|---|---|---|---|---|
| 6,254,439 | B1 * | 7/2001 | Endo | H01R 13/187 439/843 |
| 6,273,766 | B1 * | 8/2001 | Zennamo, Jr. | H01R 13/187 439/843 |
| 6,482,049 | B1 * | 11/2002 | Swearingen | H01R 4/4881 439/843 |
| 8,142,238 | B2 * | 3/2012 | Heigl | H01R 13/111 439/843 |
| 8,632,356 | B2 * | 1/2014 | Bihrer | H01R 13/18 439/442 |
| 9,515,403 | B2 | 12/2016 | Hirakawa et al. | |
| 9,608,341 | B2 | 3/2017 | Saur et al. | |
| 2014/0357137 | A1 * | 12/2014 | Sian | H01R 13/187 439/843 |
| 2016/0172770 | A1 * | 6/2016 | Ando | H01R 13/62911 439/838 |

FOREIGN PATENT DOCUMENTS

| | | |
|---|---|---|
| TW | M544721 | 7/2017 |
| WO | 2018063928 | 4/2018 |

* cited by examiner

PLUG CONNECTOR

CROSS-REFERENCE TO RELATED APPLICATION

This application claims the priority benefit of Taiwan patent application serial no. 108106175, filed on Feb. 23, 2019. The entirety of the above-mentioned patent application is hereby incorporated by reference herein and made a part of this specification.

BACKGROUND

Technical Field

The disclosure relates to a connector, more specifically, to a plug connector.

Description of Related Art

Most common electronic devices are powered by an external power source through a power supply. Generally, the power supply includes a plug connector used to plug into a socket connector of the electronic device. The plug connector has a plug portion, and the plug portion is configured with a tuning fork terminal therein. Correspondingly, the socket connector has a docking space used to accommodate the plug portion. The docking space is configured with a docking terminal inside, and the docking terminal is used fit with the tuning fork terminal. After the plug portion of the plug connector is inserted into the docking space of the socket connector, the tuning fork terminal is in contact with the docking terminal so as to conduct current.

Furthermore, the tuning fork terminal is in contact with the docking terminal at a single contact point. Since the contact area of the tuning fork terminal and the docking terminal is rather small, the contact resistance between the tuning fork terminal and the docking terminal is rather high. If heavy current flow through the tuning fork terminal and the docking terminal which are in contact with each other, the higher contact resistance between the tuning fork terminal and the docking terminal is easy to cause overheating due to excessive energy loss.

SUMMARY

The disclosure provides a plug connector capable of avoiding the overheating phenomenon.

A plug connector of one embodiment of the disclosure includes a conductive body, an insulative body, and a ring shape conductive terminal. The conductive body has an assembling hole. The insulative body is sleeved on the conductive body, wherein the insulative body has an opening hole and the assembling hole is aligned with the opening hole. The ring shape conductive terminal is assembled in the assembling hole, the ring shape conductive terminal includes a conductive inner ring, and the conductive inner ring includes a plurality of conductive portions. The conductive portions are arranged circularly and each conductive portion has at least two conductive contacts.

Based on the above, the plug connector in one embodiment of the disclosure is configured with the ring shape conductive terminal, and the ring shape conductive terminal has a plurality of conductive contacts. After the plug connector is inserted into the socket connector, the conductive contacts of the ring shape conductive terminal are in contact with the docking terminal inside the socket connector. Since the ring shape conductive terminal is in contact with the docking terminal at multiple contact points, the contact area between the ring shape conductive terminal and the docking terminal is increased, and the contact resistance between the ring shape conductive terminal and the docking terminal is lowered. Even heavy current flow through the ring shape conductive terminal and the docking terminal which are in contact with each other, the lowered contact resistance between the ring shape conductive terminal and the docking terminal can prevent overheating due to excessive energy loss from happening.

In order to make the aforementioned and other features and advantages of the disclosure more comprehensible, embodiments accompanying figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
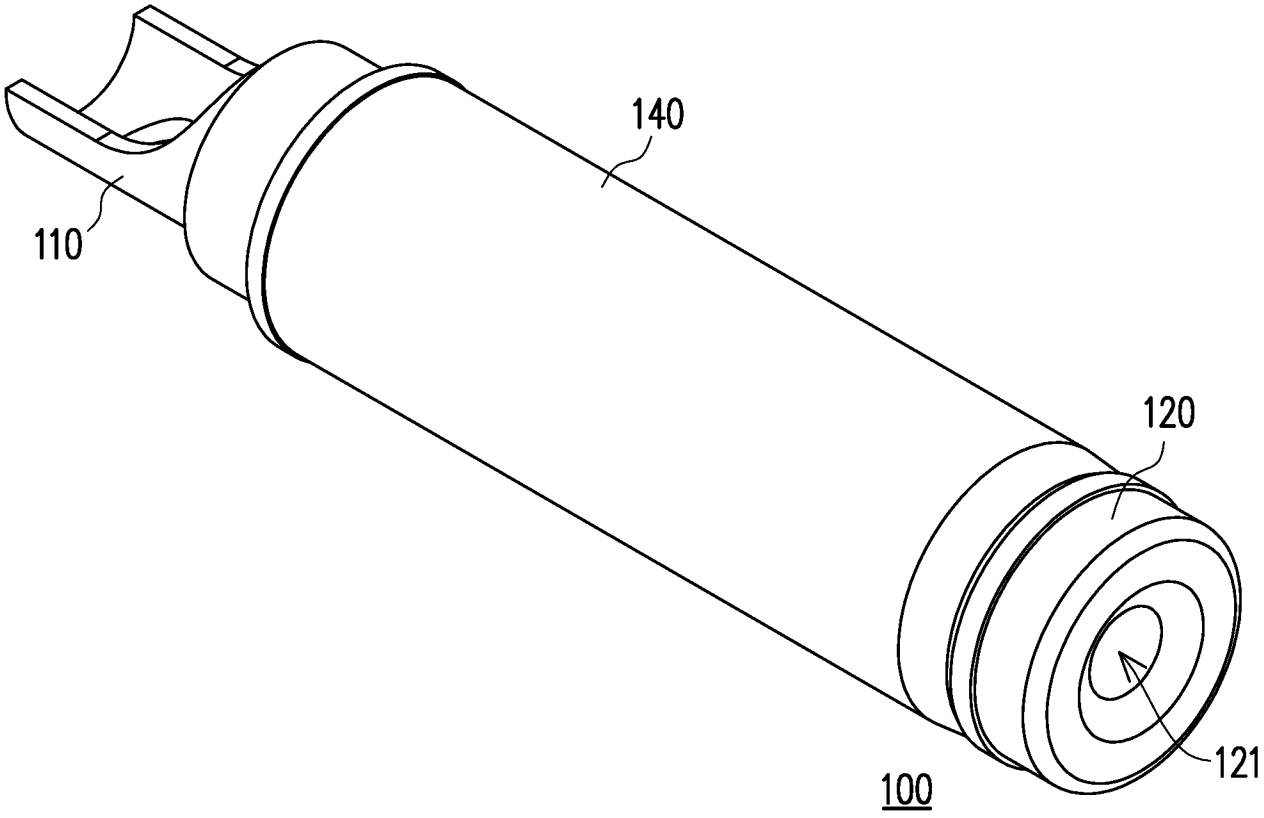
FIG. 1 is a schematic view showing a plug connector of one embodiment of the disclosure.

Reference will now be made in detail to the present preferred embodiments of the disclosure, examples of which are illustrated in the accompanying drawings. Wherever possible, the same reference numbers are used in the drawings and the description to refer to the same or like parts.

Figure 2:
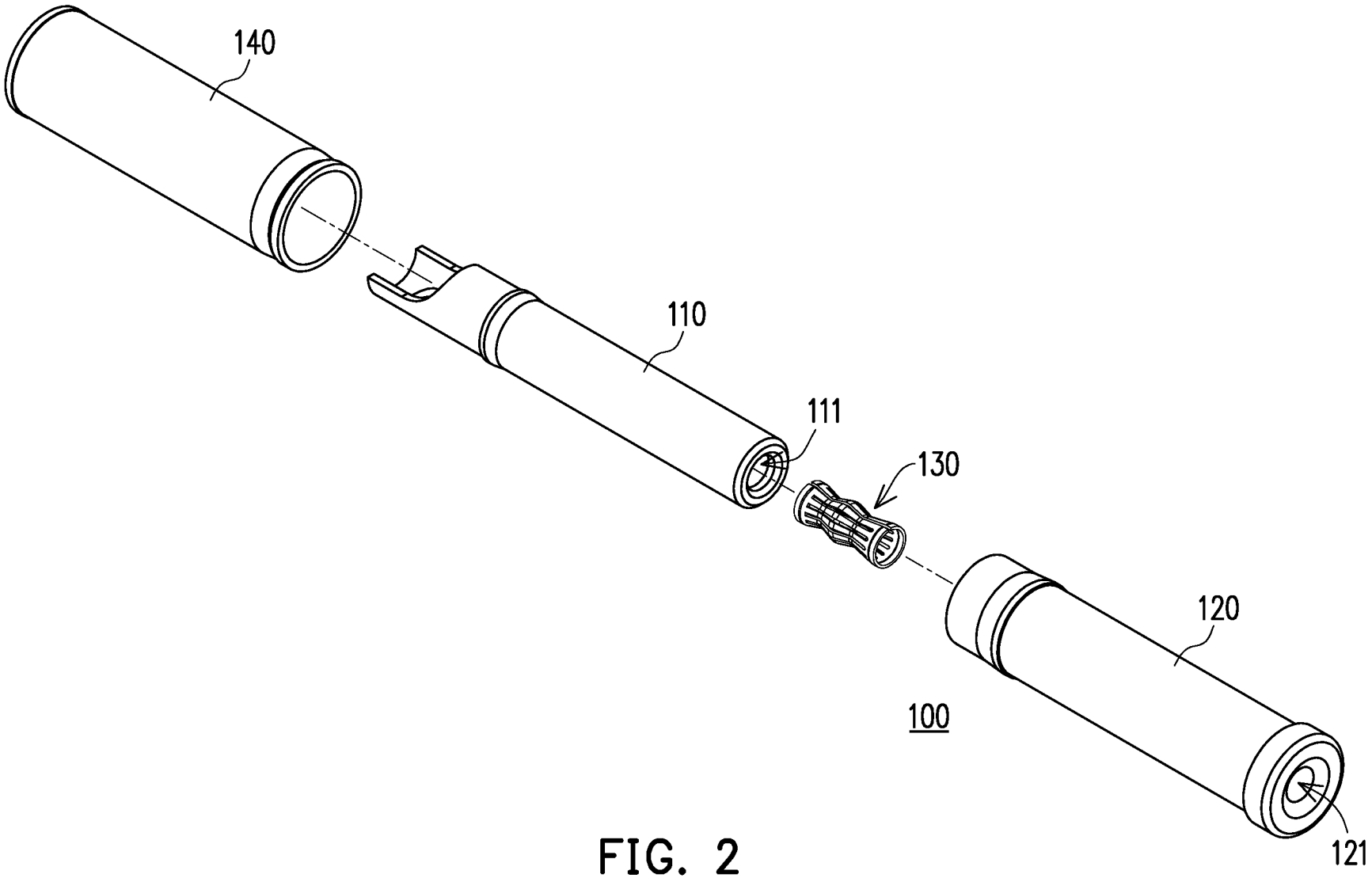
FIG. 2 is an exploded schematic view of the plug connector in FIG. 1.
Figure 3:
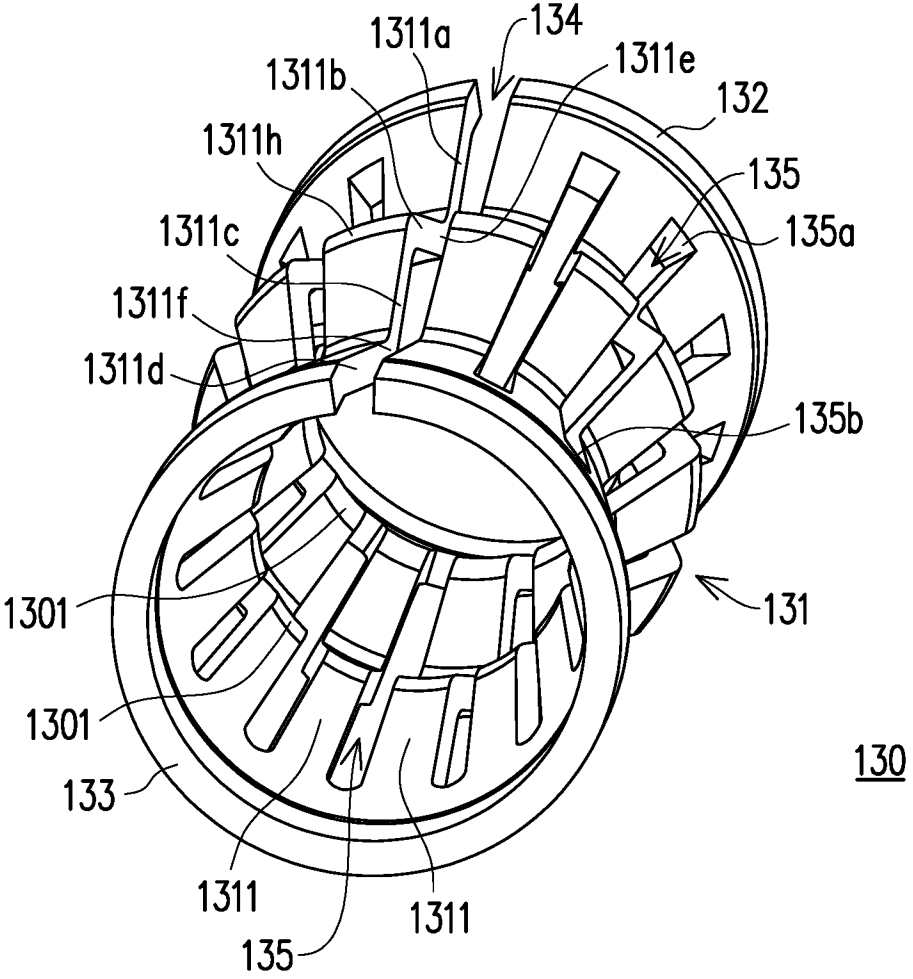
FIG. 3 is a schematic view of a ring shape conductive terminal in FIG. 2.
Figure 4:
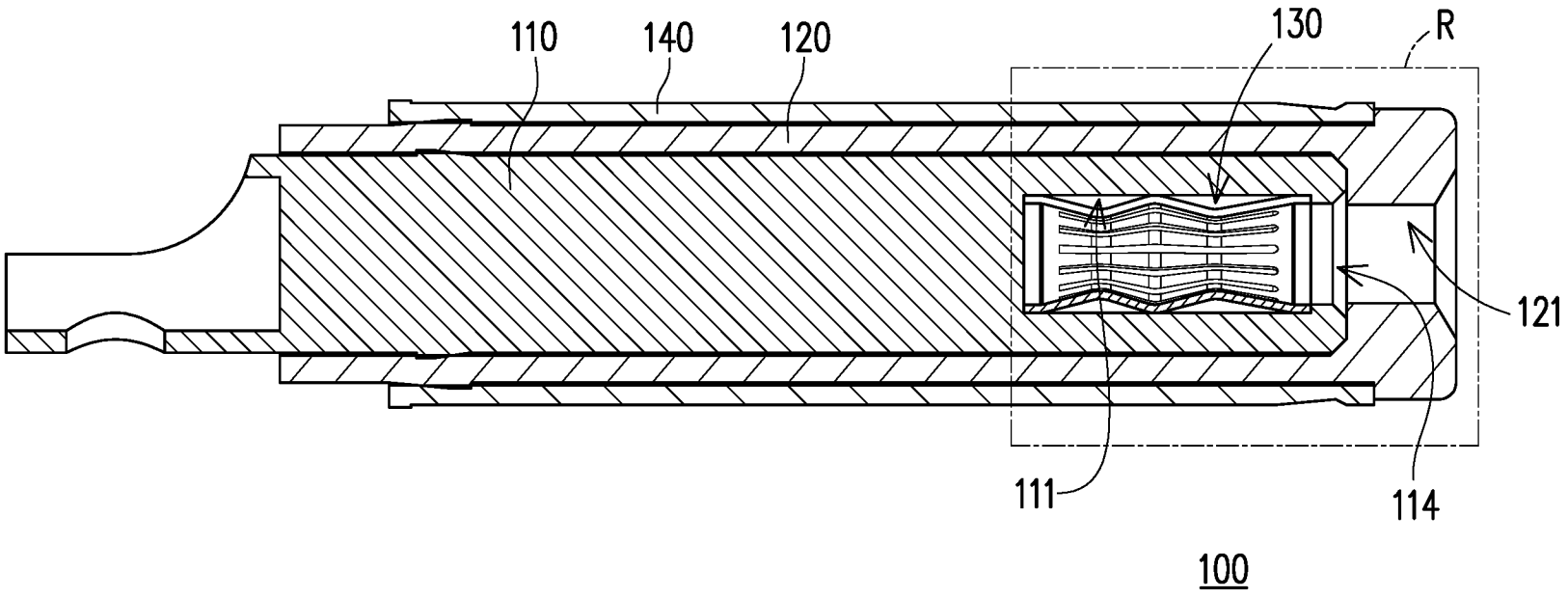
FIG. 4 is a cross-sectional schematic view of the plug connector in FIG. 1.
Figure 5:
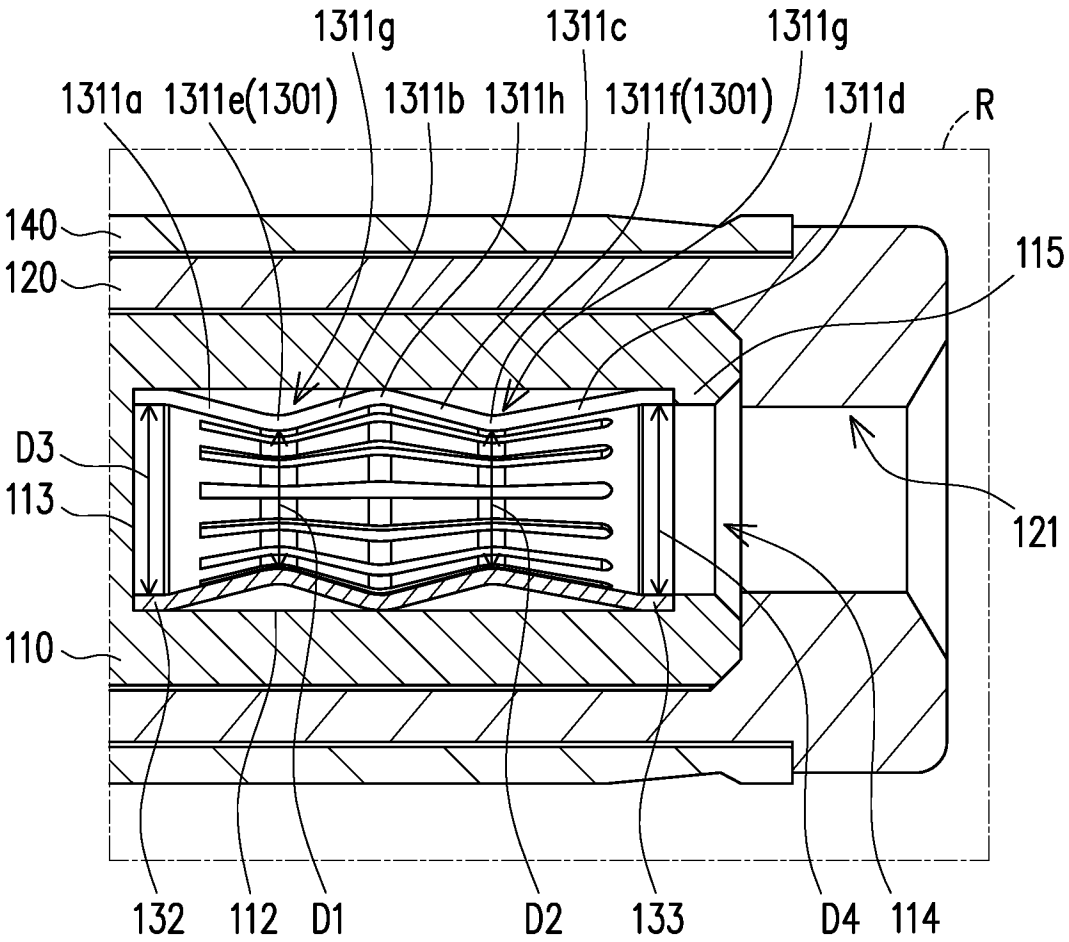
FIG. 5 is an enlarged schematic view illustrating structure of a region R in FIG. 4.

FIG. 1 is a schematic view showing a plug connector of one embodiment of the disclosure. FIG. 2 is an exploded schematic view of the plug connector in FIG. 1. FIG. 3 is a schematic view of a ring shape conductive terminal in FIG. 2. FIG. 4 is a cross-sectional schematic view of the plug connector in FIG. 1. FIG. 5 is an enlarged schematic view illustrating structure of a region R in FIG. 4. Referring to FIG. 1 to FIG. 4, in the present embodiment, a plug connector 100 may be a part of a power supply and is used to fit with the socket connector of the electronic device, so as to conduct current. To be more specific, the plug connector 100 includes a conductive body 110, an insulative body 120 and a ring shape conductive terminal 130. The insulative body 120 is sleeved on the conductive body 110, and the ring shape conductive terminal 130 is assembled in the conductive body 110. On the other hand, the plug connector 100 further includes a sleeve 140 sleeved on the insulative body 120, and the insulative body 120 is located between the sleeve 140 and the conductive body 110.

Furthermore, the conductive body 110 has an assembling hole 111 used for accommodating the ring shape conductive terminal 130. On the other hand, the insulative body 120 has an opening hole 121, and the assembling hole 111 is aligned with the opening hole 121. Therefore, after the plug connector 100 is inserted into the socket connector of the electronic device, the docking terminal inside the socket connector is inserted through the opening hole 121 of the insulative body 120 and into the assembling hole 111 of the conductive body 110 so as to in contact with the ring shape conductive terminal 130 disposed in the assembling hole 111. Since the conductive body 110 is contact with the ring shape conductive terminal 130, the current from an external power source can be conducted through the conductive body 110, the ring shape conductive terminal 130, and the docking terminal inside the socket connector to the power storage unit, such as battery, of the electronic device.

In the present embodiment, the ring shape conductive terminal 130 includes a plurality of conductive contacts 1301. After the plug connector 100 is inserted into the socket connector of the electronic device, the conductive contacts 1301 of the ring shape conductive terminal 130 are in contact with the docking terminal inside the socket connector. Since the ring shape conductive terminal 130 is in contact with the docking terminal at multiple contact points, the contact area between the ring shape conductive terminal 130 and the docking terminal is increased, and the contact resistance between the ring shape conductive terminal 130 and the docking terminal is lowered. Even heavy current flow through the ring shape conductive terminal 130 and the docking terminal which are in contact with each other, the lowered contact resistance between the ring shape conductive terminal 130 and the docking terminal can prevent overheating due to excessive energy loss from happening. Accordingly, the plug connector 100 can be applied to high power supply unit.

Referring to FIG. 3, the ring shape conductive terminal 130 includes a conductive inner ring 131, and the conductive inner ring 131 includes a plurality of conductive portions 1311. The conductive portions 1311 are arranged circularly, and each of the conductive portions 1311 includes at least two conductive contacts 1301. It should be noted here, in each of the conductive portions 1311, the number of the conductive contacts 1301 may be increased according to design requirement. On the other hand, the ring shape conductive terminal 130 further comprises the first conductive outer ring 132 and the second conductive outer ring 133 arranged side by side. The conductive inner ring 131 is located between the first conductive outer ring 132 and the second conductive outer ring 133, and each of the conductive portions 1311 is connected to the first conductive outer ring 132 and the second conductive outer ring 133.

Furthermore, the ring shape conductive terminal 130 is a ring structure that is not completely enclosed and that has a good elastic deformability. In addition, the ring shape conductive terminal 130 has a slit 134. The slit 134 penetrates through one side of the first conductive outer ring 132, the conductive inner ring 131 and the second conductive outer ring 133, and the slit 134 is located between two of the conductive portions 1311 adjacent to each other. In other words, the slit 134 is used to separate two of the conductive portions 1311 adjacent to each other, and the slit 134 is served as a buffer space when the ring shape conductive terminal 130 is deformed under pressure.

On the other hand, the conductive portions 1311 arranged circularly are arranged at intervals in the circumferential direction of the first conductive outer ring 132 or the second conductive outer ring 133. In the present embodiment, the conductive inner ring 131 further has a plurality of trenches 135, the trenches 135 are arranged circularly, and the two conductive portions 1311 adjacent to each other are separated by one of the trenches 135. The slit 134 and the two adjacent conductive portions 1311 are located between two of the trenches 135 adjacent to each other, and the two adjacent conductive portions 1311 are separated by the slit 134. In other words, the slit 134 and the trenches 135 are arranged at intervals in the circumferential direction of the first conductive outer ring 132 or the second conductive outer ring 133.

The trench 135 does not penetrates through the first conductive outer ring 132 and the second conductive outer ring 133. Each of the trenches 135 has the first end 135*a* and the second end 135*b* opposite each other, each of the first end 135*a* is located between the first conductive outer ring 132 and the second end 135*b*, and each of the second end 135*b* is located between the second conductive outer ring 133 and the first end 135*a*. Furthermore, the first end 135*a* of each of the trenches 135 is adjacent to the first conductive outer ring 132 but still keeps a distance from the first conductive outer ring 132. The second end 135*b* of each of the trenches 135 is adjacent to the second conductive outer ring 133 but still keeps a distance from the second conductive outer ring 133.

Referring to FIG. 3 to FIG. 5, in the present embodiment, each of the conductive portions 1311 presents a W-shaped structure. Each of the conductive portions 1311 has the first extending segment 1311*a*, the second extending segment 1311*b*, the third extending segment 1311*c*, and the fourth extending segment 1311*d* sequentially connected. The first extending segment 1311*a* of each of the conductive portions 1311 is connected to the first conductive outer ring 132 and is obliquely extended from the first conductive outer ring 132 to the second extending segment 1311*b*. A first turning transition 1311*e* is configured between the first extending segment 1311*a* and the second extending segment 1311*b* of each of the conductive portions 1311 (i.e., the intersection of the first extending segment 1311*a* and the second extending segment 1311*b*). On the other hand, the fourth extending segment 1311*d* of each of the conductive portions 1311 is connected to the second conductive outer ring 133 and is obliquely extended from the second conductive outer ring 133 to the third extending segment 1311*c*. A second turning transition 1311*f* is configured with the fourth extending segment 1311*d* and the third extending segment 1311*c* of each of the conductive portions 1311 (i.e., the intersection of the fourth extending segment 1311*d* and the third extending segment 1311*c*).

Based on above description, the first turning transition 1311*e* and the second turning transition 1311*f* of each of the conductive portions 1311 respectively form two conductive contacts 1301. Taking the first conductive outer ring 132 and the second conductive outer ring 133 as reference, each of the conductive portions 1311 has two recesses 1311*g*, and the two conductive contacts 1301 are the bottom points of the two recesses 1311*g*, respectively. Based on the design of the conductive contacts 1301, after the plug connector 100 is inserted into the socket connector of the electronic device, the conductive contacts 1301 of the ring shape conductive terminal 1301 are ensured to be in contact with the docking terminal inside the socket connector.

Furthermore, in each of the conductive portions 1311, the conductive contact 1301 that is closer to the first conductive outer ring 132 may be served as the first conductive contact, and the conductive contact 1301 that is closer to the second conductive outer ring 133 may be served as the second conductive contact. The first conductive contacts of the conductive portions 1311 are arranged circumferentially to define the first inner ring inner diameter D1 of the conductive inner ring 131. The second conductive contacts of the conductive portions 1311 are arranged circumferentially to define the second inner ring inner diameter D2 of the conductive inner ring 131. On the other hand, the first conductive outer ring 132 has the first outer ring inner diameter D3, and the second conductive outer ring 133 has the second outer ring inner diameter D4. The first inner ring inner diameter D1 and the second inner ring inner diameter D2 are both smaller than the first outer ring inner diameter D3 and the second outer ring inner diameter D4. Based on the design of the inner diameters of the conductive inner ring 131, the docking terminal of the socket connector can be smoothly inserted into the conductive inner ring 131 and is ensured to be in contact with the conductive contacts 1301 of the conductive inner ring 131.

Referring to FIG. 3 to FIG. 5, in the present embodiment, the assembling hole 111 of the conductive body 110 has an inner wall surface 112, a bottom surface 113 connected to the inner wall surface 112, an opening 114 opposite the bottom surface 113, and a position-limiting protrusion 115 protruding from the inner wall surface 112. The first conductive outer ring 132 and the second conductive outer ring 133 abut against the inner wall surface 112, and the first turning transition 1311*e* and the second turning transition 1311*f* of each of the conductive portions 1311 are distant from the inner wall surface 112. On the other hand, a third turning transition 1311*h* is configured between the second extending segment 1311*b* and the third extending segment 1311*c* of each of the conductive portions 1311 (i.e., the intersection of the second extending segment 1311*b* and the third extending segment 1311*c*), and the third turning transition 1311*h* is located between the first turning transition 1311*e* and the second turning transition 1311*f*.

The second extending segment 1311*b* of each of the conductive portions 1311 is obliquely extended from the first turning transition 1311*e*, and the third extending segment 1311*c* is obliquely extended from the second turning transition 1311*f*, and the second extending segment 1311*b* and the third extending segment 1311*c* intersect at the third turning transition 1311*h*. With respect to the two recesses 1311*g* of each of the conductive portions 1311, the third turning transition 1311*h* may be served as a convex section and abuts against the inner wall surface 112 of the assembling hole 111. Since the first conductive outer ring 132, the second conductive outer ring 133, and the third turning transitions 1311*h* all abut against the inner wall surface 112 of the assembling hole 111, the contact area between the conductive body 110 and the ring shape conductive terminal 130 is increased, and the contact resistance between the conductive body 110 and the ring shape conductive terminal 130 is lowered. Even heavy current flow through the conductive body 110 and the ring shape conductive terminal 130 which are in contact with each other, the lowered contact resistance between the conductive body 110 and the ring shape conductive terminal 130 can prevent overheating due to excessive energy loss from happening.

Referring to FIG. 5, the opening 114 is alighted with the opening hole 121 of the insulative body 120, and the position-limiting protrusion 115 is adjacent to the opening 114. On the other hand, the first conductive outer ring 132 faces towards the bottom surface 113, and the second conductive outer ring 133 faces towards the position-limiting protrusion 115. The first conductive outer ring 132 may or may not in contact with the bottom surface 113, and the second conductive outer ring 133 may or may not in contact with the position-limiting protrusion 115. Furthermore, the position-limiting protrusion 115 can be used to prevent the ring shape conductive terminal 130 from slipping out of the opening 114 of the assembling hole 111. The inner diameter of a portion, which is adjacent to the opening 114, of the assembling hole 111 is reduced because of the position-limiting protrusion 115, for example, the inner diameter of the portion, which is adjacent to the opening 114, of the assembling hole 111 is smaller than the outer diameter of the second conductive outer ring 133.

In summary, the plug connector in one embodiment of the disclosure is configured with the ring shape conductive terminal, and the ring shape conductive terminal has a plurality of conductive contacts. After the plug connector is inserted into the socket connector, the conductive contacts of the ring shape conductive terminal are in contact with the docking terminal inside the socket connector. Since the ring shape conductive terminal is in contact with the docking terminal at multiple contact points, the contact area between the ring shape conductive terminal and the docking terminal is increased, and the contact resistance between the ring shape conductive terminal and the docking terminal is lowered. Even heavy current flow through the ring shape conductive terminal and the docking terminal which are in contact with each other, the lowered contact resistance between the ring shape conductive terminal and the docking terminal can prevent overheating due to excessive energy loss from happening. Next, since the conductive body is in contact with the ring shape conductive terminal at multiple contact points, the contact area between the conductive body and the ring shape conductive terminal is increased, and the contact resistance between the conductive body and the ring shape conductive terminal is lowered. Even heavy current flow through the conductive body and the ring shape conductive terminal which are in contact with each other, the lowered contact resistance between the conductive body and the ring shape conductive terminal can prevent overheating due to excessive energy loss from happening.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A plug connector, comprising:

a conductive body, having an assembling hole;

an insulative body, sleeved on the conductive body, wherein an end portion of the insulative body has an opening hole and the assembling hole is aligned with the opening hole;

a ring shape conductive terminal, assembled in the assembling hole, wherein the ring shape conductive terminal comprises a conductive inner ring and the conductive inner ring includes a plurality of conductive portions, the conductive portions are arranged circularly and each of the conductive portions has at least two conductive contacts; and a sleeve, sleeved on the insulative body, wherein the end portion has an end surface and a side surface connected to the end surface, the end surface is not flush with a surface of the sleeve, and the side surface of the end portion of the insulative body is exposed from and passes through the sleeve, wherein the ring shape conductive terminal further comprises a first conductive outer ring and a second conductive outer ring arranged side by side, the conductive inner ring is located between the first conductive outer ring and the second conductive outer ring, and each of the conductive portions is connected to the first conductive outer ring and the second conductive outer ring, the first conductive outer ring has an inner end adjacent to the conductive inner ring, and the second conductive outer ring has an inner end adjacent to the conductive inner ring, the ring shape conductive terminal has a plurality of trenches, each of the trenches has a first end and a second end opposite each other, the first end of each of the trenches is adjacent to the first conductive outer ring and keeps a distance from the inner end of the first conductive outer ring, and the second end of each of the trenches is adjacent to the second conductive outer ring and keeps a distance from the inner end of the second conductive outer ring.

2. The plug connector as recited in claim 1, wherein the at least two conductive contacts of each of the conductive portions comprises a first conductive contact and a second conductive contact, the first conductive contacts of the conductive contacts are arranged circumferentially to define a first inner ring inner diameter of the conductive inner ring, the second conductive contacts of the conductive contacts are arranged circumferentially to define a second inner ring inner diameter of the conductive inner ring, the first inner ring inner diameter and the second inner ring inner diameter are both smaller than a first outer ring inner diameter of the first conductive outer ring and a second outer ring inner diameter of the second conductive outer ring.

3. The plug connector as recited in claim 1, wherein the assembling hole has an inner wall surface, a bottom surface connected to the inner wall surface, an opening opposite the bottom surface, and a position-limiting protrusion protruding from the inner wall surface, the position-limiting protrusion is adjacent to the opening, the first conductive outer ring faces towards the bottom surface, and the second conductive outer ring faces towards the position-limiting protrusion.

4. The plug connector as recited in claim 1, wherein the ring shape conductive terminal has a slit penetrating through one side of the first conductive outer ring, the conductive inner ring and the second conductive outer ring, and the two conductive portions adjacent to each other are separated by the slit.

5. The plug connector as recited in claim 1, wherein the trenches are arranged circularly, and the two conductive portions adjacent to each other are separated by one of the trenches.

6. The plug connector as recited in claim 5, wherein the first end of each of the trenches is located between the first conductive outer ring and the second end, and the second end of each of the trenches is located between the second conductive outer ring and the first end.

7. The plug connector as recited in claim 1, wherein each of the conductive portions has a first extending segment, a second extending segment, a third extending segment, and a fourth extending segment sequentially connected, the first extending segment of each of the conductive portions is connected to the first conductive outer ring, the fourth extending segment of each of the conductive portions is connected to the second conductive outer ring, the first extending segment and the second extending segment of each of the conductive portions have a first turning transition therebetween, and the fourth extending segment and the third extending segment of each of the conductive portions have a second turning transition therebetween, wherein the first turning transition of each of the conductive portions forms one of the at least two conductive contacts, and the second turning transition of each of the conductive portions forms another one of the at least two conductive contacts.

8. The plug connector as recited in claim 7, wherein the assembling hole has an inner wall surface, the first conductive outer ring and the second conductive outer ring abut against the inner wall surface, the first turning transition and the second turning transition of each of the conductive portions are distant from the inner wall surface.

9. The plug connector as recited in claim 8, wherein the second extending segment and the third extending segment of each of the conductive portions have a third turning transition therebetween, the third extending segment of each of the conductive portions is located between the first turning transition and the second turning transition, and the third turning transition of each of the conductive portions abuts against the inner wall surface of the assembling hole.

* * * * *